United States Patent [19]

Robinson

[11] 3,984,062

[45] Oct. 5, 1976

[54] TEXTILE APPARATUS

[75] Inventor: Anthony James Robinson, Macclesfield, England

[73] Assignee: Ernest Scragg & Sons Limited, Macclesfield, England

[22] Filed: Sept. 2, 1975

[21] Appl. No.: 609,822

[30] Foreign Application Priority Data

Sept. 11, 1974 United Kingdom ..... 39586/74

[52] U.S. Cl. ..... 242/43.1; 242/158.3; 242/158.5

[51] Int. Cl.[2] ..... B65H 54/32

[58] Field of Search ..... 242/43.1, 43 R, 158.3, 242/158.5

[56] References Cited

UNITED STATES PATENTS

| | | | |
|---|---|---|---|
| 3,059,874 | 10/1962 | Hays | 242/158.3 X |
| 3,373,949 | 3/1968 | Swallow | 242/43 R |
| 3,527,423 | 9/1970 | Burow | 242/43 R |
| 3,664,596 | 5/1972 | Lenk | 242/43 R |
| 3,730,448 | 5/1973 | Schippers et al. | 242/43.1 |
| 3,764,090 | 10/1973 | Gerber | 242/43.1 |
| 3,836,087 | 9/1974 | Tschentscher | 242/43.1 |

*Primary Examiner*—Stanley N. Gilreath
*Attorney, Agent, or Firm*—Michael J. Striker

[57] ABSTRACT

Yarn winder traverse mechanism incorporates a sledge which carries a yarn guide and has a cylindrical body reciprocated along a primary slide as by a helically grooved cam roll, the cylindrical body allowing the sledge to be rotated while reciprocating.

8 Claims, 2 Drawing Figures

TEXTILE APPARATUS

Figure 1:
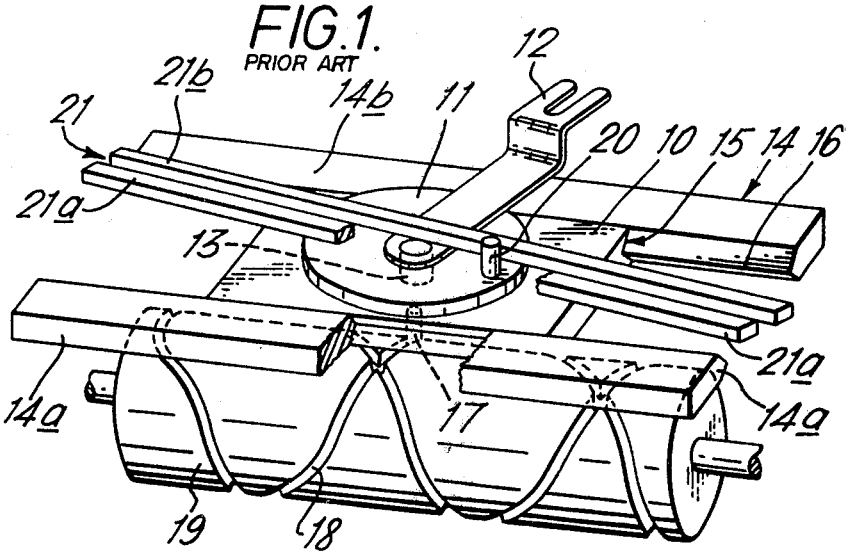
FIG. 1. PRIOR ART

This invention relates to mechanism for traversing yarn axially of a package whilst the yarn is being wound thereupon, of the type in which a yarn guide is reciprocated along a path adjacent the package and parallel to the axis of the package.

In one known traverse mechanisms of the above type the yarn guide is attached to a generally rectangular sledge supported between a pair of guide rails which also serve to constrain the sledge to move along a path parallel to the axis of the package. A pin attached to the sledge co-operates with an endless helical groove in the cylindrical surface of a rotatable cam roll so that driving the cam roll in rotation causes reciprocation of the sledge and hence the yarn guide. If, as is usually the case, it is desired to wind a package having conical ends, the above described mechanism may be modified in known manner. This is done by having the yarn guide attached to a turntable which is rotatably mounted on the sledge. A pin eccentrically disposed on the turntable is constrained by an auxiliary slide to move along a predetermined path as the sledge is reciprocated along the main slide. The auxiliary slide is arranged at an angle to the main slide so that the turntable oscillates in rotation as the sledge reciprocates, and for a given amplitude of sledge reciprocation the angle through which the turntable oscillates is dependent upon the angle between the auxiliary slide and the main slide. The amplitude of reciprocation of the yarn guide may be arranged to be less than, equal to, or greater than the amplitude of reciprocation of the sledge by suitable selection of the angle between the two slides, and if this angle is varied progressively as the package is wound the amplitude of yarn guide reciprocation may be progressively reduced so that a package having conical ends is produced.

A disadvantage of the above mechanism is that the inertia of the reciprocating parts, i.e. sledge, turntable and yarn guide, is considerable. As a consequence the frequency of the reciprocation is limited due to the high stress levels in the mechanism reached during the acceleration and deceleration periods of the traverse motion. It is an object of the present invention to provide a mechanism which will perform the above described function whilst being of both improved construction and of lighter weight and therefore capable of a higher frequency of reciprocation than the prior art mechanisms.

The invention provides a traverse mechanism comprising a sledge having a cylindrical body, a yarn guide attached to said sledge, a primary slide co-operating with the cylindrical surface of the body of said sledge and supporting and constraining said sledge to move in a linear path while allowing it to rotate, means for reciprocating said sledge along said path and means adapted to rotate said sledge about its axis while it reciprocates along said path.

The means for reciprocating the sledge may comprise a first follower attached to an end face of the sledge and co-operating with an endless helical cam groove in the cylindrical surface of a rotatable cam roll.

The first follower may comprise a pin, preferably disposed axially on the end face to which it is attached.

The sledge rotating means may comprise a second follower attached to an end face of the sledge and eccentrically disposed with respect to the axis of the sledge, the second follower co-operating with a secondary slide. The secondary slide may be adjustable angularly with respect to the primary slide. The first and second followers may be attached to opposite end faces of the sledge.

The primary slide may comprise a pair of guide rails between which the sledge is constrained to move in a linear path.

The sledge may have two spaced apart circumferential flanges which in operation are located at opposite faces of the primary slide guide rails.

Alternatively the sledge may have a single circumferential flange which may be disposed substantially centrally of the cylindrical body. In this case and in the case of a sledge not having a circumferential flange the primary slide guide rails may be of channel cross section so that in operation the flange or the sledge body engages in the channels slidably.

The secondary slide may comprise a pair of guide rails between which the second follower is constrained to move in a linear path.

One embodiment of traverse mechanism according to the invention will now be described with reference to the accompanying drawing in which FIG. 1 is a perspective view of a prior art traverse mechanism with parts of guide rails cut away for purposes of clarity.

Figure 2:
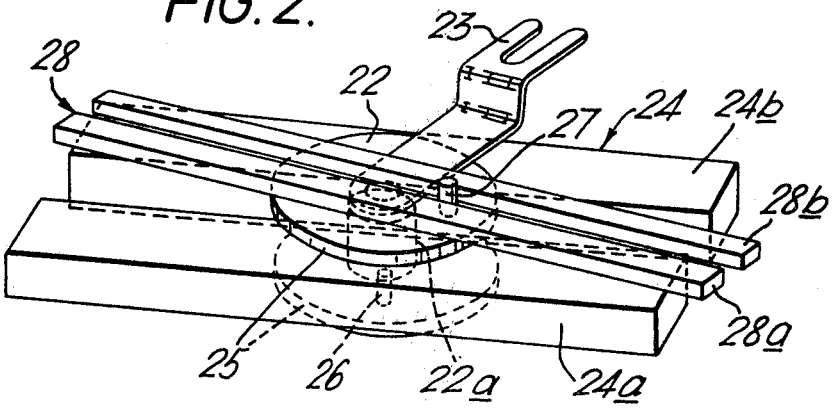

FIG. 2 is a perspective view of one embodiment of a traverse mechanism according to the invention with the cam roll omitted for purposes of clarity.

FIG. 1 illustrates a traverse mechanism comprising a rectangular sledge 10 on which is mounted a turntable 11. A yarn guide 12 is attached to the turntable 11 which is mounted for rotation on a mounting post 13 centrally disposed on the sledge 10. A primary slide 14 comprising two guide rails 14*a*, 14*b* supports the sledge 10 and constrains it to move in a linear path by virtue of vee grooves 15 in the edges of the sledge 10 co-operating with vee shaped ridges 16 on the inner facing edges of the guide rails 14*a*, 14*b*. Guide rails 14*a* is shown partially cut away for purposes of clarity. A first pin 17 is attached to the sledge 10 and co-operates with a helical cam groove 18 in the cylindrical surface of a cam roll 19. Rotation of the cam roll 19 causes the sledge 10 to reciprocate along a linear path defined by the guide rails 14*a*, 14*b*. A second pin 20 is eccentrically disposed on the turntable 11 and is constrained to move along a linear path by the guide rails 21*a*, 21*b* of a secondary slide 21. Guide rail 21*a* is shown partially cut away for purposes of clarity.

As the sledge 10 reciprocates the turntable 11 is caused to oscillate in rotation due to the second pin 20 being constrained by guide rails 21*a*, 21*b* to travel in a linear path which is at an angle to the path of travel of the sledge 10. By altering the angle between the primary slide 14 and the secondary slide 21 it is possible to arrange that the amplitude of oscillation of the yarn guide 21 is greater than, equal to or less than the amplitude of oscillation of the sledge 10. These two amplitudes are equal when the primary and secondary slides are parallel. By progressive alteration of the angle between the slides 14 and 21 the amplitude of oscillation of the yarn guide 12 may be progressively reduced so that a package having conical ends is produced. A simple mechanical linkage (not shown) between the arms carrying the package, which lift progressively as the package diameter increases, and the secondary slide 21 performs the progressive change of angle between the two slides 14 and 21.

It is a disadvantage of the above mechanism that the inertia of the reciprocating parts, i.e. the sledge 10, turntable 11 and yarn guide 12, is considerable, thus causing high stresses in the mechanism at high frequencies of reciprocation and limiting the frequency which can be achieved successfully.

In addition the contacting surfaces of the sledge 10 and the turntable 11 require greasing to reduce friction therebetween and hence wear of the surfaces. The grease adds appreciably to the weight of the reciprocating parts.

The traverse mechanism of FIG. 2 has reciprocating parts which are of less weight than those of the prior art mechanism described above, thus allowing higher frequencies of reciprocation than was heretofore possible whilst reaching only the same stress levels in the mechanism.

FIG. 2 illustrates a traverse mechanism comprising a cylindrically bodied sledge 22 to which is attached a yarn guide 23. A primary slide 24 comprising two guide rails 24*a* 24*b* co-operates with the cylindrical body 22*a* of the sledge 22 to constrain it to move in a linear path whilst allowing it to rotate, the sledge 22 being supported by virtue of the circumferential flanges 25 on the sledge 22 disposed on opposite faces of the primary slide guide rails 24*a*, 24*b*. A first follower pin 26 is attached axially to an end face of the sledge 22 in order to co-operate with a helical cam groove in the cylindrical surface of a cam roll (not shown for purposes of clarity) in exactly the same way as is described above with reference to the mechanism of FIG. 1. A second follower pin 27 is eccentrically disposed on the end face of the sledge 22 opposite to that to which the first pin 26 is attached. The second pin 27 is constrained to move along a linear path by the guide rails 28*a*, 28*b* of a secondary slide 28.

By virtue of the cylindrical shape of the body 22*a* the sledge 22 can rotate about its axis as it reciprocates, and hence the provision of a separate sledge and turntable as shown in FIG. 1 is not required, with consequent reduction of the weight of the reciprocating parts. Also, grease need not be applied to the sledge, thus reducing the weight of the reciprocating parts even further by comparison with the mechanism of FIG. 1, a suitable material for a sledge which requires no lubrication being commercially available, and being nylon filled with 50 percent by volume of minute glass spheres.

What is claimed is:

1. A yarn traverse mechanism comprising a sledge having a cylindrical body, a yarn guide attached to said sledge, a primary slide co-operating with the cylindrical surface of the body of said sledge and supporting and constraining the sledge to move in a linear path while allowing it to rotate, means for reciprocating said sledge having along said path and means adapted to rotate said sledge about its axis while it reciprocates along said path.

2. Yarn traverse mechanism according to claim 1, wherein the means for reciprocating the sledge comprises a first follower attached to an end face of the sledge and co-operating with an endless helical cam groove in the cylindrical surface of a rotatable cam roll.

3. Yarn traverse mechanism according to claim 2, wherein the first follower is a pin disposed axially on the end face to which it is attached.

4. Yarn traverse mechanism according to claim 3, wherein the sledge rotating means comprises a second follower attached to an end face of the sledge and eccentrically disposed with respect to the axis of the sledge, the second follower co-operating with a secondary slide which is angularly adjustable relative to the primary slide.

5. Yarn traverse mechanism according to claim 4, wherein the first and second followers are attached to opposite end faces of the sledge.

6. Yarn traverse mechanism according to claim 1, wherein the primary slide comprises a pair of guide rails between which the sledge is constrained to move in a linear path.

7. Yarn traverse mechanism according to claim 6, wherein the sledge has two spaced apart circumferential flanges which in operation are located at opposite faces of the primary slide guide rails.

8. Yarn traverse mechanism according to claim 4, wherein the secondary slide comprises a pair of guide rails between which the second follower is constrained to move in a linear path.

* * * * *